US006888949B1

(12) United States Patent
Vanden Berghe et al.

(10) Patent No.: US 6,888,949 B1
(45) **Date of Patent: *May 3, 2005**

(54) HEARING AID WITH ADAPTIVE NOISE CANCELLER

(75) Inventors: Jeff Vanden Berghe, Leuven (BE); Jan Wouters, Holsbeek (BE)

(73) Assignee: GN ReSound A/S (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1 day.

(21) Appl. No.: 09/470,172

(22) Filed: Dec. 22, 1999

(51) Int. Cl.[7] ..... H04R 25/00
(52) U.S. Cl. ..... 381/317; 381/312; 381/318
(58) Field of Search ..... 381/312, 316, 381/317, 318, 321, 91, 92, 122, 71.11

(56) References Cited

U.S. PATENT DOCUMENTS 5,917,921 A * 6/1999 Sasaki et al. ..... 381/94
6,178,248 B1 * 1/2001 Marash ..... 381/94.7

OTHER PUBLICATIONS

"An adaptive noise canceller for hearing aids using two nearby microphones" Jeff Vanden Berghe, Jan Wouters, Journal of Acoustical Society of America, Jun. 1998.

* cited by examiner

*Primary Examiner*—Suhan Ni
(74) *Attorney, Agent, or Firm*—Michael J. Bolan; Bingham McCutchen LLP

(57) ABSTRACT

A noise reduction system for a sound reproduction system, in particular for hearing aids, comprises a primary and a secondary microphone for producing input signals in response to sound in which a noise component is present. The system has a first signal processing section comprising a fixed filter and a summing function, wherein the first signal processing section has means for receiving signals from the microphones and producing a speech reference signal and a noise reference signal. A second signal processing section comprises an adaptive filter and an additional summing function, and the second signal processing section has means for receiving the speech and noise reference signals and producing an output signal with an improved signal-to-noise ratio.

7 Claims, 1 Drawing Sheet

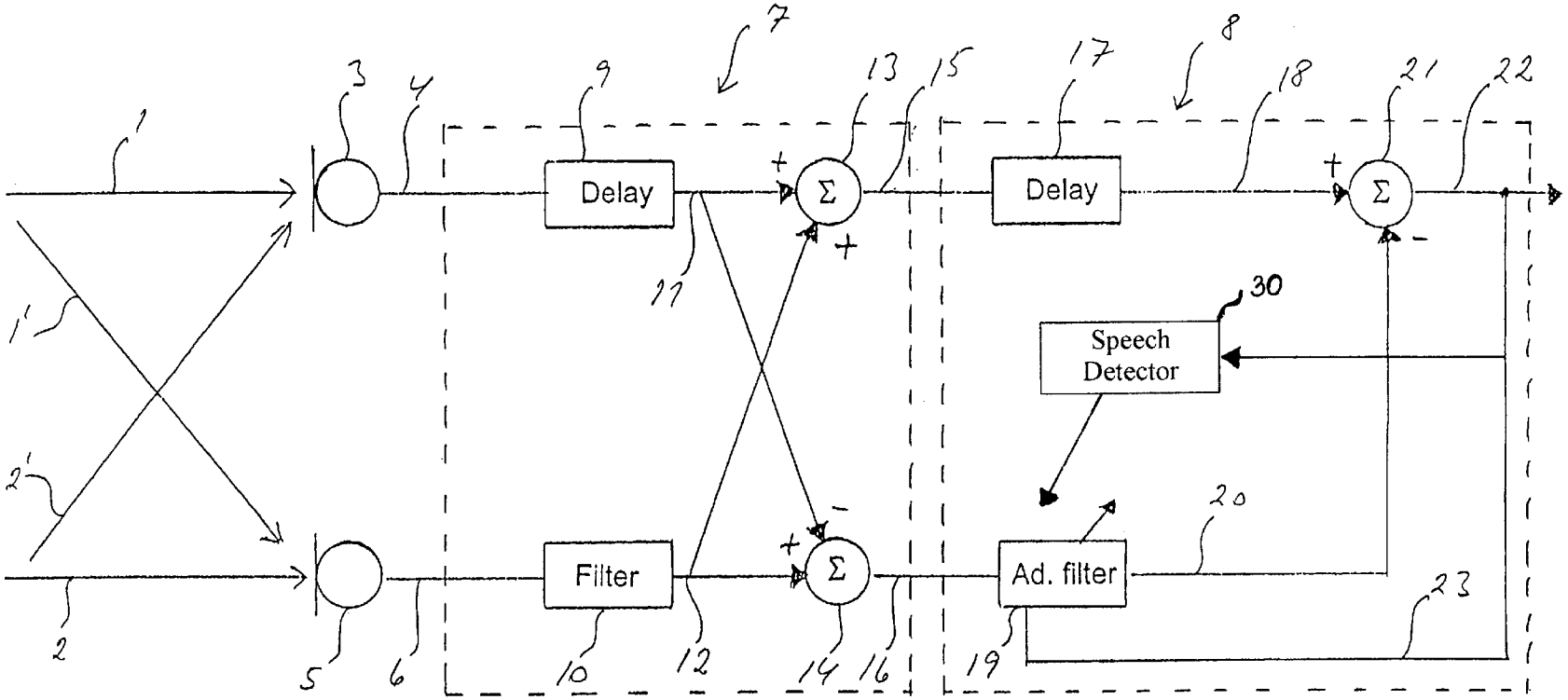
Delay
Delay
Filter
Ad. filter
Speech Detector
Σ
Σ
Σ
+
-
1
1'
2
2'
3
4
5
6
7
8
9
10
12
13
14
15
16
17
18
19
20
21
22
23
30

HEARING AID WITH ADAPTIVE NOISE CANCELLER

FIELD OF THE INVENTION

The invention relates to improvements in noise cancelling or noise reduction systems for sound reproducing systems, such as hearing aids and cochlear implants, and in particular systems using two microphones and adaptive noise reduction. The unwanted noise in this connection comprises any interfering signals, jammer signals, undesirable signals, which can even be speech signals. When the term"noise" is used in the following, it will be understood that this term comprises such signals. The invention thus relates to the reduction of such signals in relation to the speech, which can be defined as the desired signal or the target signal.

BACKGROUND OF THE INVENTION

The problem of reduced speech intelligibility of persons with normal hearing and in particular hearing impaired persons under adverse listening conditions, such as restaurants, traffic and other noisy environments, is well known.

Efforts have been made to improve this situation for users of hearing aids, as a number of techniques based on single- and multi-microphone systems have been applied to suppress unwanted background noise.

Single-microphone systems have utilised directional microphones and/or signal filtering, e.g. spectra-filtering, in order to reduce the background noise in relation to the desired signal, i.e. the speech signal.

Multi-microphone systems using fixed beam-forming have been proposed, where the incoming sound can be sampled spatially, and the direction of arrival can be used for discriminating desired from undesired signals. With these systems it is possible to suppress stationary and non-stationary noise sources independently of their spectra. However, in order to achieve an effective cancelling of the undesired signals, the size of the microphone array will be considerably larger than the average size of commonly used hearing aids, e.g. behind-the-ear (BTE) or in-the-ear (ITE) hearing aids.

Multi-microphone systems using adaptive noise cancelling have also been proposed. In these proposed noise cancelling systems adaptive noise cancellation is used to try to null out the interfering noise source or sources. An example of such a system is disclosed in Journal of the Acoustical Society of America, 103 (6), June 1998, pp. 3621–3626, J. Vanden Berghe and J. Wouters:"An adaptive noise canceller for hearing aids using two nearby microphones".

In the above article a noise cancelling system using two nearby microphones is described, which system contains two sections, in which the signals are processed. The signals from the microphones, which contain both noise and speech, are led to the first section, which serves to generate a speech reference signal and a noise reference signal. These reference signals are led to the second section, which produces an output signal, in which the noise has been reduced in relation to the speech signal. Each section in this system comprises an adaptive filter. The first section in this piece of related art comprises an adaptive filter, the output of which is intended to converge towards a delayed signal from the primary microphone, while the adaptive filter in the second section of the system models the difference between the noise reference and the delayed speech reference, and subsequently the noise portion in the delayed speech is subtracted.

SUMMARY OF THE INVENTION

It is an object of the present invention to provide an adaptive noise cancelling system, which leads to improved speech intelligibility.

It is a further object of the present invention to provide an adaptive noise cancelling system, which can be used in connection with hearing aids worn entirely by the user, e.g. behind-the-ear (BTE), in-the-ear (ITE) or completely-in-the-canal (CIC) hearing aids and cochlear implants.

It is still another object of the present invention to provide a hearing aid with an improved adaptive noise cancelling system and comprising two microphones.

These and other objects of the invention are obtained with a noise reduction system, which comprises a primary and a secondary microphone for producing input signals in response to sound, in which a noise component is present, said system comprising:

- a first signal processing section comprising a fixed filter and a summing function, wherein the first signal processing section has means for receiving signals from the microphones and producing a speech reference signal and a noise reference signal; and
- a second signal processing section comprising an adaptive filter and an additional summing function, wherein the second signal processing section has means for receiving the speech and noise reference signals and producing an output signal with an improved signal-to-noise ratio.

Further, the objects of the invention are obtained by a hearing aid apparatus comprising:

- two microphones for converting sound waves to electrical signals;
- a first signal processing section comprising a fixed filter and a summing function, wherein the first signal processing section has means for receiving signals from the microphones and producing a speech reference signal and a noise reference signal; and
- a second signal processing section comprising an adaptive filter and an additional summing function, wherein the second signal processing section has means for receiving the speech and noise reference signals and producing an output signal with an improved signal-to-noise ratio.

By using a fixed filter in the first section, a system is achieved which is robust under adverse conditions. Further, the system has the advantage that under adverse signal-to-noise ratio conditions it will not have problems with the tracking of the desired signal, which may be the case with systems with an adaptive filter in the first section, leading to distortion of the desired signal. When an adaptive filter is used in the first section, tracking of the wrong signal may cause problems for a while, until the adaptive filter returns to the desired source, and the user's own voice may cause an adaptive filter in the first section to deviate from the ideal setting. Such problems are avoided with the system and with the hearing aid according to the invention.

THE DRAWING

The invention will now be described in more detail with reference to the drawing, in which the FIGURE shows a block diagram of a noise reduction system according to the invention.

DESCRIPTION OF THE PREFERRED EMBODIMENT

In the FIGURE is shown an overview of the system according to the invention. A hearing aid with two microphones 3 and 5 receives a speech signal 1 as well as a noise signal 2. One of the microphones is the primary microphone 3, which serves to pick-up the speech signal 1, although it also receives part of the noise signal 2'. The other or secondary microphone 5 serves to pick-up the noise signal 2, but also receives part of the speech signal 1'.

The microphones 3 and 5 may be directional or omni-directional microphones. In an embodiment of the invention the primary microphone 3 is a directional microphone, while the secondary microphone 5 is an omni-directional microphone. In another embodiment of the invention the primary microphone 3 is an omni-directional microphone, and the secondary microphone 5 is also an omni-directional microphone. In a further embodiment both microphones are directional microphones.

Since an omni-directional microphone needs only one microphone port, while a directional microphone needs two ports or more, four microphone ports will be necessary in the embodiment having two directional microphones. Similarly, only two ports are needed for the embodiment having two omni-directional microphones, while the embodiment having one omni-directional and one directional microphone will need three ports. The embodiment using two omni-directional microphones can be transformed to a configuration corresponding to the embodiment using one omni-directional and one directional microphone through an additional transformation by a delay and a subtractive operation. This embodiment can thus be achieved using only two ports.

The electrical signal 4 from the primary microphone 3 and the electrical signal 6 from the secondary microphone 5 are led to a first signal processing section 7 of the system. It will be understood that these electrical signals contain both speech and noise signals. Further, it will be-understood that the noise cancelling system operates as a digital system, and thus the electrical signals have been converted to digital form. The conversion from analogue to digital form is not indicated in FIG. 1, but is implied. Also, it will be understood that a possible conversion of signals from two omni-directional microphones to one directional microphone is not indicated in the figure either.

The first signal processing section 7 serves to reduce or eliminate the speech signal in relation to the noise signal in the resulting signal 16. The input signal 6 is led to a filter 10, and this filter together with the summing function 14 filter the desired signal out of the noise reference signal. The output signal 16 thus contains a smaller rate of speech signal than the input signal 6.

One method of determining the coefficients of the filter 10, which ideally allows speech to pass, may comprise a setting by calibration with a long-term average speech spectrum, but other methods might be used as well.

The electrical signal 4 from the primary microphone 3 is led to a delay function 9. The output signal 11 from the delay function 9 is led to a first summing function 13 and a second summing function 14 as shown in the figure. However, the first summing function 13 is optional and may be omitted.

In the summing function 14 the delayed output signal 11, which contains both speech and noise, is subtracted from the output signal 12, which is the output of the filter 10, and the resulting signal 16 thus ideally contains much less speech than the input signal 6. The output signal 16 will also be denoted"the noise reference".

The first summing function 13, which as mentioned above is optional, serves to add the delayed output 11 to the output 12 from the filter 10, thus resulting in the signal 15, which has a high proportion of speech. This resulting signal is also denoted"the speech reference".

The speech reference 15 and the noise reference 16 are led to the second signal processing section 8 of the system. An adaptive filter 19 receives the noise reference 16, and the output 20 is led to a third summing function 21.

The third summing function 21 also receives a signal 18, which is the speech reference signal 15 delayed by a delay function 17. The noise signal 20 is subtracted from the delayed speech reference signal 18, thus resulting in an output signal 22. This signal also serves as control input signal 23 for the, adaptive filter 19. This filter 19 is allowed to adapt, when speech signals are not dominating, in order to model the difference between the noise reference 16 and the noise portion of the delayed speech reference 18.

The detection of speech in the output signal 22 can be carried out by means of a real-time speech detector,3., based on energy measurements in time intervals. In the embodiment illustrated by the drawing, the output signal 22 is detected by the speech detector 30. The speech detector 30, however, may operate on any signal in an apparatus that contains a speech signal, such as one of the signals 4, 15, and 22 in the drawing. In the embodiment illustrated by the drawing, the signals 15 or 22 may be preferred because of their good speech-to-noise ratio. The speech detector (30) calculates both speech onset and offset thresholds as a function of momentary noise statistics. In evaluating whether or not a speech signal is present, the speech detector 30 takes into account the speech peak energy as well as the variability of this energy. Any speech detector that in a reliable manner can detect the presence of a dominating speech signal in a condition with good signal-to-noise ratio (e.g.,$\geqq$+5 dB) may be used as the nature of the speech detector will not be crucial to the invention. However, preferably the speech detector 30 is completely energy-based with all thresholds dynamically adapting to the environment.

The output 22 from the noise cancelling system is usually further processed in a sound reproducing system, such as a hearing aid or a cochlear implant, in the usual manner until a resulting signal is led to a sound reproducer. This processing, which may be of any kind known to a person skilled in the art, will not be further described.

The delay functions 9 and 17 allow for good filtering performance with short filters and for simulating non-causal filters. The setting of these delay functions may be about half of the corresponding filter-length.

As mentioned above, the microphones may be directional or omni-directional microphones, and the directional microphones can be obtained using two or more microphone ports.

If both microphones 3 and 5 are directional, at least four microphone ports are needed, and this embodiment provides a high degree of noise reduction.

In the embodiment where both microphones are omni-directional microphones only two ports are needed, thus providing a cost-efficient solution, a flat frequency response, and a good signal quality in noise-free environments.

If the primary microphone 3 is a directional microphone and the secondary microphone 5 is an omni-directional microphone, at least three ports are needed, but this embodiment provides good signal quality both in noisy and in noise-free environments.

As described above, it is possible to obtain the characteristics of the embodiment having one directional microphone and one omni-directional microphone by using two omni-directional microphones. This has the advantage that only two ports are needed, it is possible to use the noise reduction capability in noisy environments, and it is possible to use the high-quality signal characteristics in noise-free environments.

The noise cancelling system according to the invention can be utilised in a hearing aid or in a cochlear implant, which comprises a digital signal processor (DSP). In this way the noise cancelling system can be integrated or is feasible in hearing aids and cochlear implants without increasing the size of the instrument.

What is claimed is:

1. A noise reduction system for a sound reproduction system, in particular for hearing aids, comprising:

a primary microphone outputting a first signal in response to received speech signals and received noise signals;

a secondary microphone outputting a second signal in response to said received speech signals and said received noise signals;

a first signal processing section comprising:

a first signal delaying means, wherein said first signal is input into said first signal delaying means;

a fixed filter, wherein said second signal is input into said fixed filter; and a first summing function, wherein a first signal delaying means output is subtracted from a fixed filter output by said first summing function to produce a noise reference signal; and a second signal processing section comprising:

a second signal delaying means, wherein a speech reference signal output by said first signal processing section is input into said second signal delaying means;

an adaptive filter, wherein said noise reference signal is input into said adaptive filter, wherein said adaptive filter has an adaptive mode of operation and a non-adaptive mode of operation, and a second summing function, wherein an adaptive filter output is subtracted from a second signal delaying means output by said second summing function to produce an output signal with an improved signal-to-noise ration, and wherein said adaptive filter operates in said non-adaptive mode of operation when speech dominates said output signal and operates in said adaptive mode of operation when speech does not dominate said output signal.

2. The noise reduction system according to claim 1, wherein the fixed filter in the first section has filter coefficients, which are set by calibration with a long-term average speech spectrum.

3. The nose reduction system according to claim 1, wherein the adaptive filter in the second section is controlled by the output signal from the second section.

4. The noise reduction system according to claim 1, wherein the primary microphone is a directional microphone and the secondary microphone is an omni-directional microphone.

5. The noise reduction system according to claim 1, wherein the primary microphone is an omni-directional microphone and the secondary microphone is an omni-directional microphone.

6. The noise reduction system according to claim 1, wherein the primary microphone is a directional microphone and the secondary microphone is a directional microphone.

7. The noise reduction system according to claim 1, further comprising a third summing function, wherein said first signal delaying means output and said fixed filter output are combined by said third summing function to produce said speech reference signal.

* * * * *